United States Patent [19]

Leins et al.

[11] 4,364,246

[45] Dec. 21, 1982

[54] KNITTING MACHINE

[75] Inventors: Eberhard Leins, Filderstadt; Manfred Walter, Aichtal; Willi Gaiser, Gäufelden, all of Fed. Rep. of Germany

[73] Assignee: Sulzer Morat GmbH, Fed. Rep. of Germany

[21] Appl. No.: 224,691

[22] Filed: Jan. 13, 1981

[30] Foreign Application Priority Data

Feb. 1, 1980 [DE] Fed. Rep. of Germany ..... 3003570

[51] Int. Cl.[3] ..... D04B 35/00

[52] U.S. Cl. ..... 66/145 R; 66/125 R

[58] Field of Search ..... 66/123, 126 R, 134, 66/140, 145 R, 64 R, 60 R, 75.1

[56] References Cited

U.S. PATENT DOCUMENTS

| | | | |
|---|---|---|---|
| 4,103,517 | 8/1978 | Schmid et al. | 66/75.1 |
| 4,173,874 | 11/1979 | Sommer et al. | 66/125 R |
| 4,204,414 | 5/1980 | Vinnemann et al. | 66/145 R |
| 4,287,728 | 9/1981 | Schmid et al. | 66/125 R |

*Primary Examiner*—Ronald Feldbaum

[57] ABSTRACT

Knitting machine for performing knits having a beginning and an end, which has at least one needle bed in which knitting needles are mounted for extension and retraction, which has a plurality of thread carriers running successively along an endless path and having at least one thread inserter and one thread gripper, the thread carriers being transportable through a working section and through a return section for the return transport of the threads from the end of the knit to the beginning of the knit for the insertion of threads into select needles, and having furthermore at least one thread clipper for severing the threads after they have been worked by the last active needle each time and after they have been gripped in the corresponding thread gripper, and having a control apparatus suitable for varying the knit width for the opening or closing of the thread grippers for the purpose of the release or of the gripping of the thread ends produced by the clipping device and carried by the thread carriers in their return travel, the associated inserters and thread grippers being spaced from one another in a direction different from the transport direction of the thread carriers at least immediately prior to the insertion of the corresponding threads into the first selected needles, such that the thread portions disposed between them are each caught by the first extended needles in the direction of transport and are brought into the position required for the next-following selected needles (FIG. 2).

30 Claims, 9 Drawing Figures

KNITTING MACHINE

BACKGROUND

The invention relates to a knitting machine of the kind defined in the introductory part of claim 1.

In known knitting machines of this kind (German Offenlegungsschrift No. 2,351,741) the inserting means and the thread grippers are disposed substantially successively in the direction of transport. For this reason, the thread grippers must be at such a distance from the inserting means that a needle that is knitting will have been retracted again before it is overtaken by the thread gripper. Since furthermore the thread grippers must be situated lower than the tips of the extended needles in order to assure a reliable insertion of the threads, the thread carriers must have a relatively great structural length and successive knitting systems must be disposed at relatively great intervals.

Another problem in the delivery of threads to knitting machines of the kind mentioned in the beginning is that the thread ends released by the thread grippers at the beginning of the knit often come within the reach of the first needles that knit and therefore are also knitted into the beginning of the knit, thereby spoiling a portion of the knit along a width corresponding to the length of the thread end. To prevent this, thread carriers are known which have inserting means and thread grippers disposed successively in the transport direction, with which vacuum nozzles are associated at the beginning of the knit (German Auslegeschrift No. 2,325,747) or mechanically or electromagnetically operated grippers are associated (Swiss Pat. No. 427,122). Such systems are relatively complicated and troublesome, and particularly they interfere with the simple changing of the width of the knit or the installation of automatically operating devices for increasing and decreasing.

The invention is addressed to the problem of simplifying and improving the thread transport and the thread carriers in a knitting machine of the kind defined above, in order thus to achieve a great convenience of operation and permit the width of the knit to be changed by simple means, as in the case, for example, of increasing or decreasing. Furthermore, the thread transport is to assure that the rest of the desired functions of a thread carrier, such as for example holding the thread ends out of the reach of the needles when the thread ends have been released at the beginning of the knit, floating the threads at any desired point in the knit, cutting out a particular thread carrier, providing needle latch openers and latch holder parts, as well as the easy replacement of the thread grippers, doing so with simple means, without impairing the convenience of operation or diminishing the reliability of the insertion of the threads at high knitting speeds.

The distinguishing features of claim 1 are provided for the solution of this problem.

In accordance with the invention, prior to their insertion into the first active needles, i.e., needles which are to be active in the knit, the threads or the thread ends held between the inserters and the thread grippers are disposed, not lengthwise of the needle beds but transversely thereto. This results in a number of advantages, explained in the description given below, with regard to the various functions of the thread carriers and to the thread feed in general.

The invention can be applied to all circular knitting machines and especially to flat knitting machines in which the problems mentioned above are encountered. The invention is applied with special advantage to knitting machines which are described in German Offenegungsschrift Nos. 2,531,705, 2,531,734, 2,531,762 and 2,701,652.

Additional advantageous features of the invention will be found in the subordinate claims.

The invention will be further explained below by means of embodiments in conjunction with the appended drawing, wherein.

Figure 1:
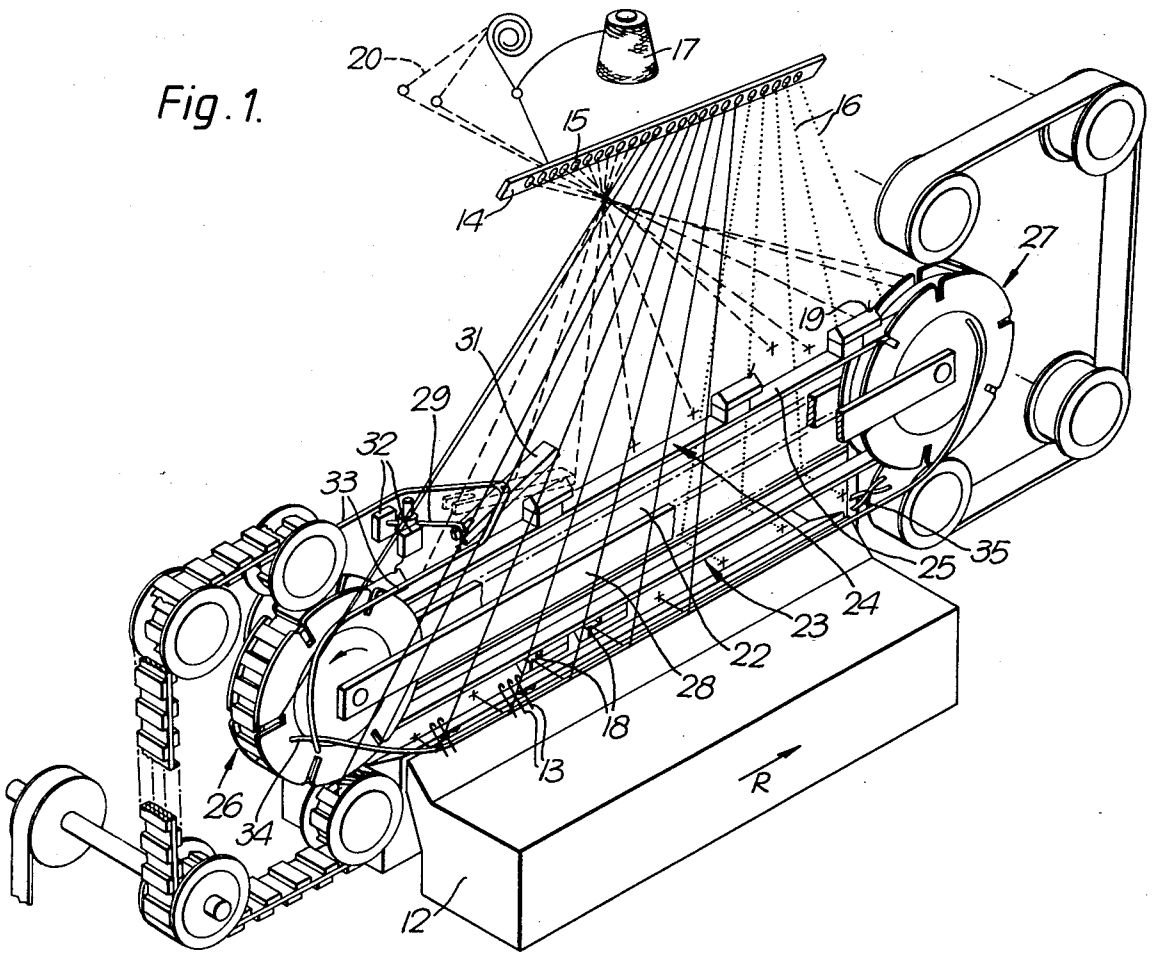
FIG. 1 is a perspective, diagrammatic representation of a knitting machine to which the invention is preferentially applied.
Figure 2:
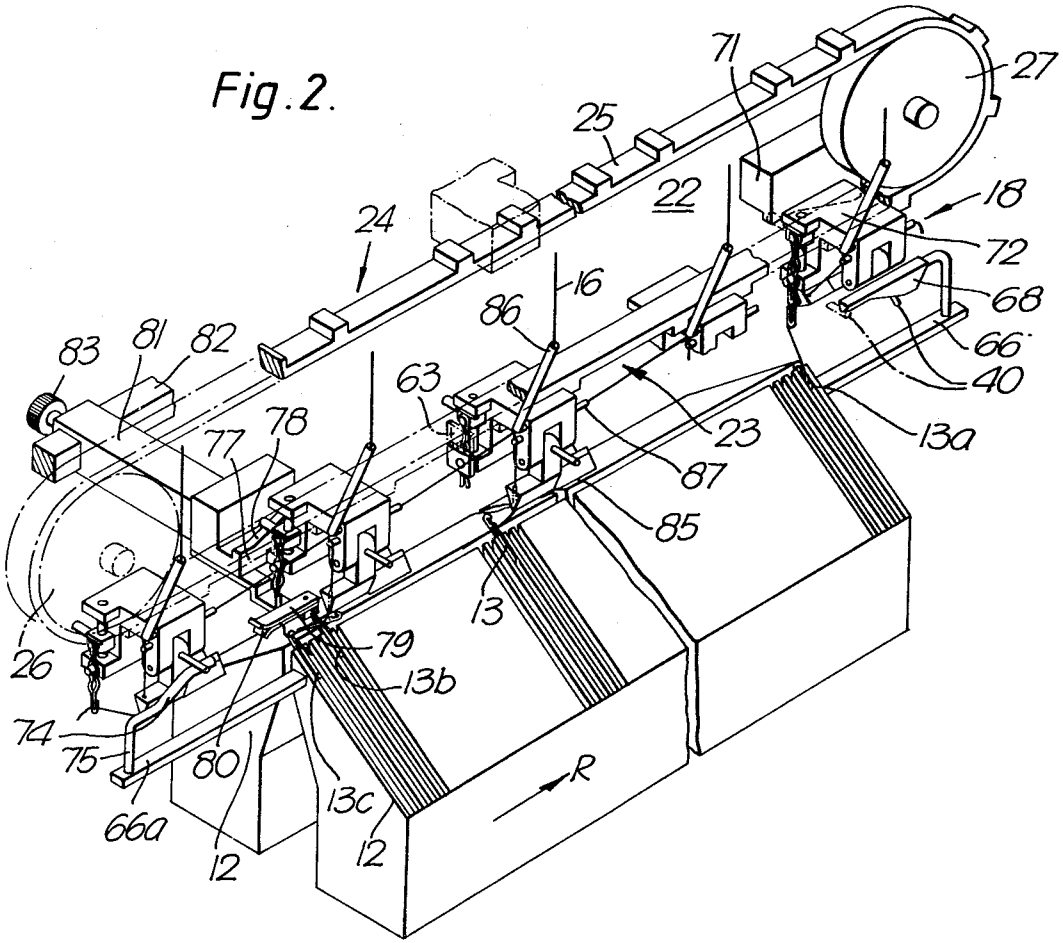
FIG. 2 is a diagrammatic and perspective representation of the knitting machine of FIG. 1 having thread carriers in accordance with a first embodiment of the invention.

In FIGS. 1 and 2 there is represented a known flat knitting machine having two needle beds 12 disposed in an inverted vee arrangement, in whose grooves knitting needles 13 are held for longitudinal displacement in a known manner. The knitting needles 13 define, when they are all fully extended, a work section disposed parallel to the needle beds 12 and closely above the crossing formed by the needles 13, on which the threads have to be presented to the needles in order to be caught by the latter and worked in loops. Additional details of the flat knitting machine which are not necessary for the comprehension of the invention can be seen for example in German Offenlegungsschirft Nos. 2,531,762, 2,531,705 and 2,531,734. For the sake of simplicity, it is assumed in the following description that the two needle beds 12 are each at an angle of about 45° to a vertical plane and have their top edges parallel and horizontal. If a different arrangement of the needle beds is anticipated, and they are disposed, for example, vertically or horizontally, the following data concerning the position, arrangement or attitude of various parts of the thread carriers must be modified accordingly.

Above the machine there is provided a stationary eyelet board 14 disposed preferably parallel to the work section, through whose eyelets 15 a plurality of threads 16 are carried from stationary spools 17 to a plurality of thread carriers 18 having inserting means 19 containing thread holes, and above the eyelet board 14 there is indicated one holding means 20 for each thread 16, which, during the return of a thread carrier 18, serves to hold the piece of thread which is released during that phase.

For the transport of the thread carriers 18 there is provided an endless circulation path 22 comprising an upper section 24 and a lower section 23 running above the line of action of the inserters 19 and parallel thereto. In section 23, the thread carriers 18 are carried along with the inserters 19 pointing downwardly for the insertion of the threads 16 into the needles 13. After reaching the end of the knit, which is on the right side in FIG. 1, the thread carriers 18 are returned along section 24 with the inserters 19 pointing upwardly, to the beginning of the knit which is on the left in FIG. 1, and during this return phase they do not feed threads to the needles.

The circulation path 22 is formed by an endless, flexible belt 25 on which the thread carriers 18 are fastened, and which is held by two pulleys 26 and 27 whose shafts are mounted in the ends of a rigid bar 28. In order to bring it about that the threads 16, during the repeated circulation of the thread carriers 18 in the direction of an arrow R, will pass alternately along first one and then the other broad side of the circulation path 22 and consequently not entangle with one another, a deflector 31 is provided which can be swung back and forth by means of a control lever 29 and two electromagnets 32 from the position represented in solid lines in FIG. 1 to the position shown in broken lines, and vice versa. The deflector 31 is adjoined by two guide wires 33 which receive the threads 16 distributed to the one or the other broad side of the circulation path 22 and transfer them to one or the other guide wire 34, so as to assure that the threads do not come in contact with any parts of the thread feed or of the knitting machine. Further details that may be necessary to the understanding of the invention can be found in German Offenlegungsschrifts Nos. 2,531,762 and 2,701,652.

The manner of operation of the thread feed system of FIGS. 1 and 2 is as follows: Upon the repeated circulation of the thread carriers 18, the threads 16 are gripped at the end of the work section by thread grippers which are disposed on the thread carriers 18, and are then cut by a cutting means 35. The gripped thread ends are returned to the beginning of the work section and there they are again released by the thread grippers. Each thread 16, upon the completion of one revolution of belt 25, reaches the deflector 31, and is alternately deflected thereby to one or the other side of the circulation path 22, thereby preventing entanglement of the threads 16.

In conjunction with FIGS. 2 to 7, two first embodiments of the thread carriers 18 and 18', respectively, are to be described, by means of which the threads are inserted, knitted, gripped and cut according to a pattern. The directions, positions and locations given for the various parts relate, unless otherwise stated, to the case in which the thread carriers move along section 23 of circulation path 22 in the direction of the arrow R. Equivalent parts are designated with the same reference numbers in each case.

Figure 5:
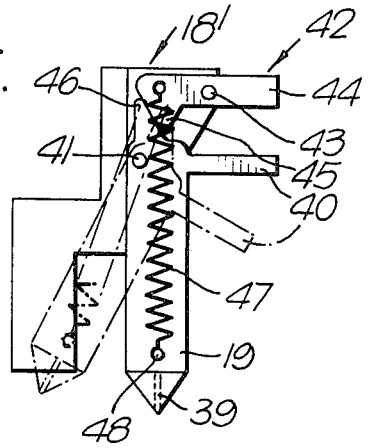
FIG. 5 is a diagrammatic front view of the thread carrier of FIG. 3 showing two positions of the thread inserter.

Each thread carrier 18, 18' contains an inserter 19 whose bottom end is of a V-shaped cross section and has a thread eyelet in the form of a through bore 39 (FIG. 5), while the upper end is fastened pivotingly on a pivot pin 41 to the thread carrier 18, 18'. A control lever 40 fixedly attached to the inserter 19 serves for rocking the inserter 19. The axis of the pivot pin 41 is parallel to the direction of transport (arrow R in FIGS. 1 and 2) and horizontal, so that the bottom end of the bore 39 from which the thread 16 emerges, can be pivoted transversely of the direction of transport to the two end positions represented in FIG. 5. In FIG. 5 the position represented in solid lines is the working position, while the non-working position of the inserters 19 is represented in broken lines.

While the two positions of the inserters 19 in the thread carrier 18 in FIG. 2 are not secured by special means, the thread carrier 18' of FIGS. 3 to 7 has, for the securing of the two said positions, a locking means 42 (FIG. 5) in the form of a lever which is mounted on a lock pivot 43 parallel to the direction of transport, and whose one arm is in the form of a control lever 44 while its other arm bears a downwardly pointed, wedge-shaped locking lug 45 which engages one side of the upwardly pointed wedge-shaped projection 46 of the inserter 19 in the working position and the other side thereof in the non-working position. A tension spring 47 is provided for holding the inserter in these two positions, one end being fastened to the arm of lever 42 which bears the locking lug 45 and the other end to the pin 48 provided at the bottom of the inserter 19. At the same time the engaging flanks of the locking lug 45 and of the projection 46 are of such configuration, as seen in FIG. 5, that, when the inserter 19 is in the working position, and a pressure is exerted on the inserter 19 towards the non-working position, the flanks are pressed even more tightly together than they are by the action of the tension spring 47, and no movement will result, while on the other hand, when the inserter 19 is to be returned from the working position to the non-working position, a downward pressure exerted on the operating lever 44 will lift the locking lug 45 away from the projection 46, permitting the inserter 19 to be turned by a light pressure back from the nonworking position to the working position.

Figure 3:
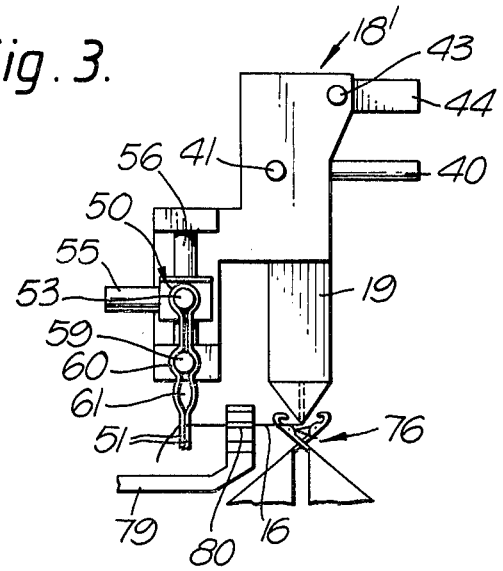
FIG. 3 is a diagrammatic front view of a thread carrier of the invention in a second embodiment, with the thread gripper closed.

Furthermore, each thread carrier 18' (FIG. 6) contains a vertically disposed thread gripper 50 in the form of a hairpin-like element made of bent spring wire and having two resilient legs terminating in jaws 51, which are resiliently pressed together in the normal position represented in FIG. 3. At the upper end of thread gripper 50 there is provided a mounting loop 52 (FIG. 7) whereby the thread gripper 50 is mounted on a pin 53 which is fastened to a block 54 and has a lever 55 projecting laterally outwardly. The block 54 is displaceably mounted on a vertical shaft 56 and its downward displacement is limited by a stop 57. When the thread gripper 50 is in the closed position represented in FIG. 3, in which the block 54 engages the stop 57, the pin 53 is at such a distance from an operating pin 59 fixedly fastened to the thread carrier 18 and disposed parallel to it that operating pin 59 extends precisely into a first opening 60 between the two legs of the thread gripper 50, which has a diameter corresponding to the diameter of the operating pin 59, so that the thread gripper 50 remains closed. By raising the block 54 to the position shown in FIG. 4, the thread gripper 50 is brought to its open position, because the operating pin 59 in this case extends into a second opening 61 between the two legs of the thread gripper 50 which has a smaller diameter than opening 59. The two above-defined positions of the block 54 are secured by the detent action of the operating pin 59 in the openings 60 and 61. While the stop 57 serves to prevent the thread gripper 50 from moving beyond the bottom detent, which would result in an undesired opening, no stop is required for the open position represented in FIG. 4 because any movement of the thread gripper 50 beyond the upper detent position would not change the open state of the thread gripper.

Figure 4:
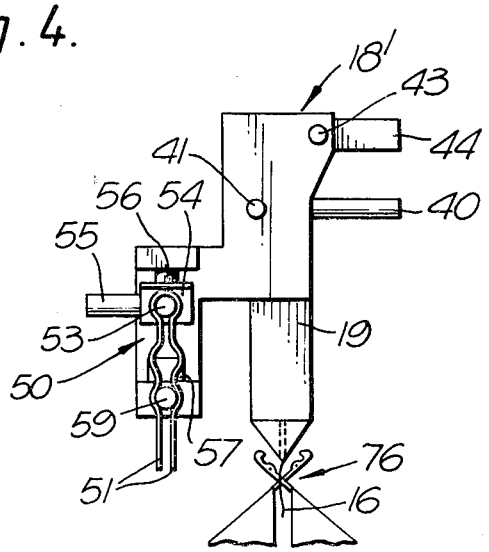
FIG. 4 is a diagrammatic front view of the thread carrier of FIG. 3 with the thread gripper open.
Figure 9:
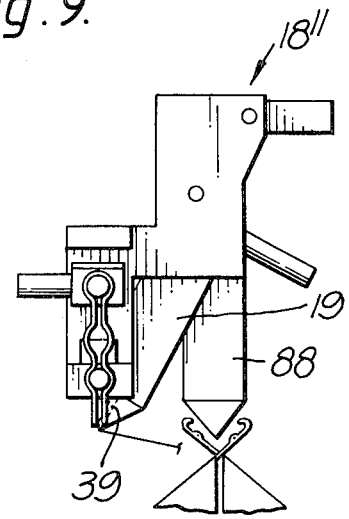
FIG. 9 shows the thread carrier of FIG. 8 in the position required for the catching of the knitted thread.

In FIGS. 3 and 4, the inserter 19 and the thread gripper 50 are offset transversely of the direction of transport and spaced apart from one another, such that they will move along parallel paths. At the same time, this spacing and the length of the inserter 19, as measured from the pivot pin 41 to the bottom end of the bore 39, is made such that, when the inserter 19 is in the working position and the thread gripper 50 is in the closed position as represented in FIG. 3, a thread gripped between the gripper and the bottom end of the bore 39 will be stretched out approximately horizontally and transversely of the direction of transport. The offset in the direction of transport, however, is made so great that the inserter, when the thread gripper is open (FIG. 4), can be pivoted to its non-working position represented in FIG. 5 such that the bottom end of bore 39 will be on the one hand directly ahead of the thread gripper 50 in the transport direction, and on the other hand will be directly adjacent the gripper jaws 51, as can be seen also in FIG. 9 representing a third embodiment of the thread carrier.

By turning the block 54 by about 90° on the shaft 56, the thread gripper 50 can be released from the pin 53 and can then be removed. In the position represented in FIG. 6, corresponding to the detented open state of the thread gripper 50, the thread gripper 50 is still held securely on the pin 53 by a cover plate 63 which is fastened on the front of the thread carrier 18', since the pin 53 is just outside of the cover plate 63. If the block 53 is raised further upwardly until it encounters a mounting plate 64 which bears the shaft 56 and is at a greater distance from the cover plate 63 than the height of the block, the block can be turned approximately 90° to the position shown in FIG. 7. The pin 53 will thus automatically come out of the eye 52 thereby releasing the thread gripper 50, because the thread gripper 50 is unable to rotate with the block 54 by the cover plate 63. The thread gripper 50 can therefore then be removed upwardly and replaced with a new thread gripper 50 for whose installation it is necessary only to push the gripping elements 51 over the pin 59 until its top eye 52 is at the level of the block 54, and then rotate the block 90°, whereupon the pin 53 will automatically enter into the fastening eye 52.

When the knitting needles 13 are latch needles, the leading end of each inserter 19, being V-shaped, serves as a latch holder to keep the latches of needles 13 open, and is provided with a latch opener 85 (FIG. 2) in the form of a brush which serves to open any latches that might still be closed on the extended needles 13.

Before the threads 16 fed to the inserters 19 enter into the bores 39, they are carried each through a tube 86 (FIG. 2) which can pivot on the corresponding thread carrier 18, and which serves as a guard and, instead of the threads 16, each tube is shifted by the deflector 31 (FIG. 1) alternately to one or the other side of the circulation path 22. The arrangement can be such, in accordance with FIG. 2, that the tube 86 of any thread carrier 18 always carries the thread 16 which is received by the thread carrier next following 18 through an additional tube 87 and is inserted into the knitting needles 13.

Figure 8:
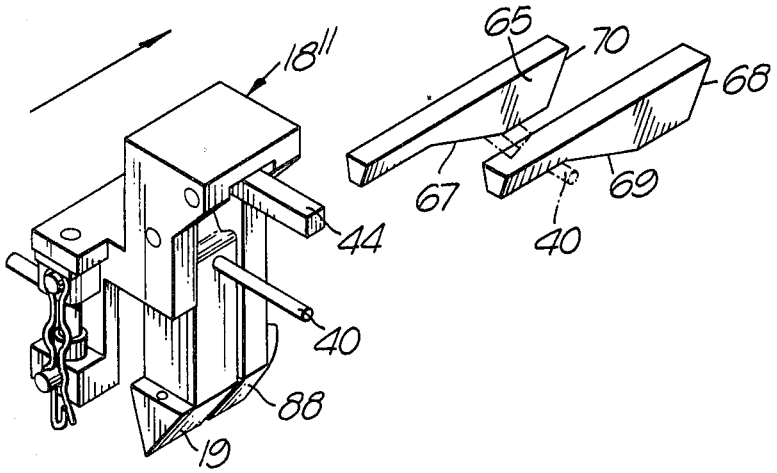
FIG. 8 shows a third embodiment of the thread carrier of the invention.

The embodiment of thread carrier 18" in FIGS. 8 and 9 differs from the other embodiments in that, ahead of the inserter 19 and between the latter and the corresponding latch opener 85, a latch holder 88 of V-shaped cross section is provided which is fastened fixedly to each thread carrier 18", and which serves to keep the latches of the knitting needles 13 open, and can be partially overlapped by the latch opener 85. The inserter 19, when in its working position, forms a prolongation of the latch holder 88 (FIG. 8), but when it is in its non-working positions, a space is created between the latch holder 88 and the inserter 19, which permits the passage of the knitting needles that have been extended (FIG. 9).

In the case of continuous knitting, the inserters 19 assume the working position represented in FIG. 2, until they have reached the last knitting needle indicated at 13*a* at the right end in FIG. 2. After knitting needle 13*a* has been passed, each inserter 19 is swung to the non-working position shown at the right end in FIG. 2, which can be seen in FIG. 5. For this purpose, if the lock 42 is present (FIGS. 3 to 9), first a cam 65 acting on the control lever 44 and forcing it downwardly (FIG. 8) is provided, which is fastened to the needle beds and has a downwardly sloping cam surface 67 onto which the control lever 44 runs in order to permit the inserter 19 to be tilted by pulling the locking lug 45 away from the projection 46. Just behind the end of the sloping cam surface 67 begins a second cam 68 fastening to a rail 66 (FIGS. 2 and 8), and provided with a downwardly sloping surface 69 which acts on the control lever 40, presses it downwardly, and thereby turns the corresponding inserter to the nonworking position. At the end of the sloping surface 69 begins an upwardly sloping surface 70 of the guide cam 65, which brings it about that the control lever, which is subject to the action of the tension spring 47, will gradually, and therefore controlledly, swing back to the position in which it is represented in FIGS. 3 to 5 and 8 and 9, and the locking lug 45 will therefore snap behind the lug 46 (FIG. 5). During this process, the thread grippers 50 are in the open state shown in FIG. 5. If the lock 42 is not provided (FIG. 2), only the cam 68 is provided.

After the inserter 19 has been turned out of the non-working position, the bottom end of bore 39 is now according to FIG. 9 just in front of the jaws 51 of the open thread gripper 50. Since at this moment the thread 16 is still held by the last knitting needle 13*a*, a portion of the thread is therefore directly under and approximately in the center between the bottom ends of the jaws 51. Therefore, immediately after inserter 19 has been swung to the non-working position, an additional cam 71 (FIG. 2), which is fastened to rail 66 and acts on the control lever 55, and which has a downwardly sloping surface 72, will cause the block 54 and with it the thread gripper 50 to shift back to the closed state represented in FIG. 3, and thread 16 will be seized and held fast by the two gripper jaws 51. Then the thread 16 can be cut, by means of the cutting device 35 shown only in FIG. 1, at a point between the thread gripper 50 and the end of the knit defined by the needle 13*a*.

After the corresponding thread end has been gripped, each thread carrier 18, 18' and 18" is returned by means of the pulleys 26 and 27 and section 24 of the circulation path to the beginning of the knit defined by the first active needle 13*b* (FIG. 2). Just before the beginning of the needle beds 12 and a cam 75 fastened to a rail 66*a* (FIG. 2) and having an upwardly sloping cam surface 74 is provided, which acts on the control lever 40 of each entering inserter 19 and swings the latter back into the working position, so that the bottom end of the bore 39, as shown in FIG. 3, is brought closely above the needle crossing 76 formed by the needles 13, and consequently the thread 16 is disposed transversely of the direction of transport and substantially horizontally.

As any of the thread carriers 18, 18' or 18" continues its movement, the corresponding transversely tensed thread 16 lays itself approximately at the level of the tip and above the crossing 76 in back of the shank of the first active needle **13*b* of the front needle bed 12 in FIG. 2, being thereby turned and disposed approximately in the direction of transport, so that it can be laid both into the first active needle 13*b* as well as in all of the extended needles 13 that follow, and can be knitted by these needles. At a location situated in back of the point of insertion for the first knitting needle 13*b*, there is an additional cam 77 which has an ascending ramp surface 78 (FIG. 2) which cooperates with the operating lever 55 and serves to lift the block 54 and with it the thread gripper 50 to the open state shown in FIG. 4**, so that the thread end is released at the proper time at the beginning of the knit.

In order to prevent the thread end released in this manner from being also caught by the knitting needles 13 when the succeeding thread carriers 18, 18', 18" enter the work area, a gripper 79 (FIGS. 2 and 3) is provided ahead of the first knitting needle **13*b* and is equipped with two gripping jaws pressed resiliently together. The two free ends of these two gripper jaws pointing against the direction of transport from an inlet gap 80 (FIGS. 2 and 3) at the level of the transversely tensed thread 16, into which the thread ends transported by any of the thread carriers are inserted and thereby gripped and held out of reach of the first active needles. The tension of the goods being formed by the knitting will, bit by bit, draw the thread ends thus gripped back out of the gripper 79 as the work continues, without any danger of their being knitted into the goods. The gripper 79 is furthermore, as shown in FIG. 3, disposed between the inserter 19 and the corresponding thread gripper 50**.

Since as shown in FIGS. 2 and 3 the transversely tensed thread 16 can only be seized by the first active needles of one of the needle beds—the front needle bed in this case—provision is also made in accordance with the invention for catching the thread transversely tensed by the inserters 19 and the thread grippers 50, not with the first active needle each time, but with a starting needle **13*c* which does not participate in the knitting process, thus tensing the thread lengthwise of the needle beds 12 and bringing it to the desired insertion position. The starting needle 13*c* is in the front needle bed 12 and approximately two or three needle slots ahead of the first knitting needle 13*b*, and is extended by known patterning means far enough to reliably capture the transversely tensed threads 16. As best seen in FIG. 2, in this procedure it matters not whether the first active needle 13*b* is a needle of the front or rear bed, since the thread 16 is reliably caught and knitted by each needle 13*b***.

The cam 77 and the gripper 79 are best fastened to a common holder 81 which can slide on a horizontal rail 8 parallel to the upper edge of the needle bed and can be locked in any desired position by means of a set screw 83 (FIG. 2). By adjusting the position of the holder 81, the location at which the thread grippers 50 are opened can be adjusted, so that the opening position can always be adapted precisely to the position of the active needle **13*b* that is selected as the first in the individual case. In this manner it is possible by simple means to make a change in the width of the knit in the area of the beginning of the knit, since otherwise it is necessary only to establish by means of the patterning device which needle 13*b* is to act first and accordingly also, which is to be the corresponding starting needle 13*c*. The width of the knit in the area of the end thereof can be changed by displacing accordingly the cams 65, 68 and 71 and, if necessary, also the thread clipper 35**.

The system described is also suitable for the continuous increasing or decreasing of the knit width, if controllable stepping motors or the like are additionally provided for the displacement of the above-mentioned cams parallel to the needle bed upper edge automatically and according to pattern, and if the needles 13 can be selected in accordance with the displacement performed in the individual case.

The invention is not limited to the embodiments described above. For example, the cam 75 can also be fastened displaceably on the rail **66*a* and be engaged or disengaged by means of an electromagnet or a mechanical control, for example. If the cam 75 is disengaged, it does not act on the operating lever 40 of the inserters 19, so that the latter remain in the non-working position and no threads can be inserted during their passage over the needle beds. In this case, provision must be made through an appropriate control means that cam 77 is also disengaged and consequently the thread gripper 50 of the corresponding thread carrier 18, 18' and 18"** remains closed.

Furthermore, it is desirable to fasten the entire thread carrier 18, 18' or 18" by means of a pivot bolt on a carrier attached to the belt 25 such that it can be pivoted manually to a working position or a non-working position, and can be locked in either position by means of a detent, a pushbutton or the like. At the same time the axis of the pivot bolt is best disposed perpendicularly to the direction of transport. In this manner the operation of the machine is considerably simplified, since any desired needle sector can be exposed at any time by swinging out the thread carrier that is above it.

Instead of the gripper 79, other devices having a similar function can be provided, such as for example brushes, especially wire brushes, or two confronting flat or round brushes.

Lastly, the arrangement is not limited to arranging the thread gripper on the left side of the corresponding inserter 19 as seen in FIG. 3 and/or arranging the thread end held between it and the inserter 19 in a horizontal position. Instead, the thread gripper 50 can also be disposed on the right of the inserter 19, in which case the starting needle **13*c* would be located in the rear needle bed 12, and the held thread end could be disposed at an angle from the horizontal and/or from the direction of transport, provided it is assured that it is reliably caught by the starting needle 13*c* or by the first knitting needle 13*b***, as the case may be.

Special advantages of the invention are to be seen in the fact that the thread carrier 18, 18', 18", permits a plurality of functions in spite of a short structural length, and the threads are reliably and precisely inserted by mechanical means instead of compressed air. Furthermore, the knit Gestrick width is variable by relatively simple means both at the beginning and at the end of the needle beds. Lastly, both the replacement of a defective thread gripper 50 and also the swinging away of the entire thread carrier 18, 18' or 18" out of the working area can be performed in a few steps, resulting in great convenience of operation.

We claim:

1. Knitting machine for performing knits having a beginning and an end, with at least one needle bed in which knitting needles are mounted for extension and retraction, with a plurality of thread carriers running successively on an endless path, which have at least one thread inserter and one thread clamp each, and are transportable through a work section for the insertion of threads into selected needles and through a return section for the return transport of threads from the end of the knit to the beginning of the knit, also with at least one thread cutting device for the cutting of the threads after their working by the last knitting needle and after they have been gripped in the corresponding thread gripper, and with a control device suitable for changing the knit width for the opening or closing of the thread grippers for the release or gripping of the thread ends obtained by means of the cutting device and carried by the thread carriers in the return transport, characterized in that the inserters (19) and thread grippers (50) which are associated with one another are, at least immediately before the insertion of the corresponding threads (16) into the first selected needles (13), spaced apart in a direction differing from the transport direction of the thread carriers (18) such that the thread portions disposed between them are each time caught by the first extended needle (13*b*) in the direction of transport and brought to the position necessary for the needles next selected.

2. Knitting machine of claim 1, characterized in that the inserters (19) during the transport of the thread carriers (18, 18', 18'') are guided through the work section on a path parallel to the upper edge of the needle bed (12) and closely above the crossing (76) formed by the needles (13).

3. Knitting machine of claim 1 or 2, characterized in that cams (71, 77) extending lengthwise of the needle bed (12) are provided for the opening and closing of the thread grippers (50).

4. Knitting machine of any of claims 1 or 2, characterized in that the inserters (19) are pivotable perpendicularly to the direction of transport.

5. Knitting machine of any of claims 1 or 2, characterized in that with each inserter (19) two fixed pivotal positions are associated such that the inserter (19), in its one pivotal position corresponding to the nonworking position, is disposed, as seen in the transport direction, immediately ahead of the corresponding thread gripper (50) (FIG. 9).

6. Knitting machine of any of claims 1 or 2, characterized in that the thread grippers (50) have each two jaws (51) which can be spread trasversely to the transport direction to an open position or compressed to a closed position.

7. Knitting machine of claim 6, characterized in that the thread grippers (50) are opened and closed by an up and down movement substantially perpendicular to the direction of the pivoting of the inserters (19) and perpendicular to the direction of transport.

8. Knitting machine of claim 4, characterized in that cams (68, 75) extending longitudinally of the needle bed (12) are provided at the beginning of the needle bed and at the end of the needle bed for the swinging of the inserters (19).

9. Knitting machine of claim 7, characterized in that, for the production of the up-and-down movement of the thread grippers (50), cams (71, 75) are provided which extend longitudinally of the needle bed (12) and are disposed at the beginning and end of the needle bed.

Figure 7:
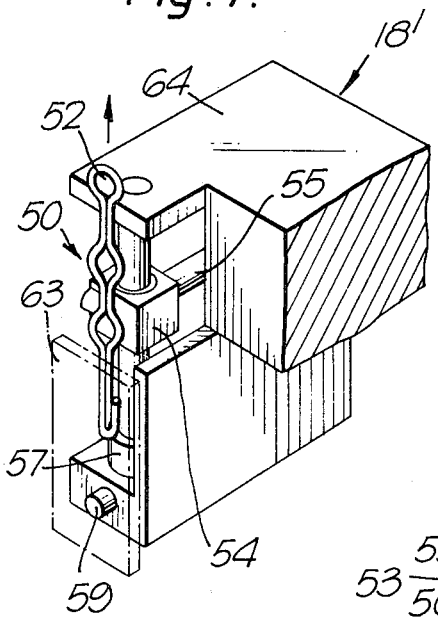
FIGS. 6 and 7 show diagrammatic, perspective views of a portion of the thread carrier of FIGS. 3 to 5 with the details necessary for the replacement of a thread gripper.
Figure 6:
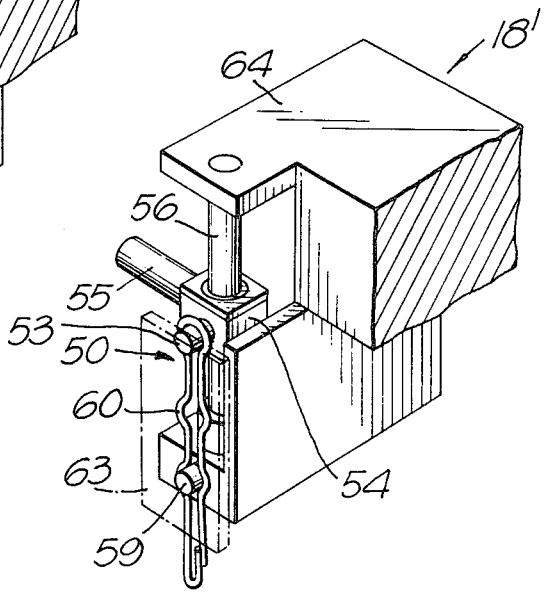

10. Knitting machine of claim 6, characterized in that each thread gripper (50) consists of a U-shaped element having two resilient arms forming the gripping elements (51), and a fastening eye (52) is provided at their junction (FIG. 7).

11. Knitting machine of claim 10, characterized in that the two arms in their normal position are pressed resiliently together and have in a central section two eye-like expansions (60, 61) for the accommodation of a control pin (59) (FIG. 3).

12. Knitting machine of claim 11, characterized in that the thread carrier (18, 18', 18'') has a bearing body (54) mounted rotatably on a shaft (56) and displaceable longitudinally thereof, having a bearing pin (53) engaging in the fastening eye (52), and a rigidly mounted control pin (59) extending between the arms, the arrangement being made such that the bearing body (54) is held against rotation between the two positions defined by the engagement of the control pin (59) in the expansions (60, 61), and the thread gripper (50), when the control pin (59) engages the one eye-like expansion (60), is closed and, when the control pin (59) is engaged in the second eye-like expansion (61), is open.

13. Knitting machine of claim 12, characterized in that the bearing body (54) can be displaced beyond the detent formed by the expansion (61) into a third position in which it can be rotated on the axis (56) for the purpose of removing the bearing pin (53) out of the fastening eye (52) and releasing the thread gripper (50).

14. Knitting machine of claim 1, characterized in that, if latch needles are used, a latch opener (85) fastened to the thread carriers is provided ahead of each inserter in the direction of transport (FIG. 2).

15. Knitting machine of claim 14, characterized in that the latch opener (85) is a brush.

16. Knitting machine of claim 14 or 15, characterized in that each thread carrier (18'') has, in addition to the pivoting inserter (19), a latch holding part (88) disposed ahead of the inserter in the transport direction and affixed to the thread carrier (18) for holding the latches opening, the latch holder directly adjoining the latch opener (85) or being partially overlapped by the latter (FIGS. 8, 9).

17. Knitting machine of claim 16, characterized in that each inserter (19) is pivotingly fastened to the corresponding thread carrier (18'') such that, in the nonworking position, a gap is provided between the inserter (19) and the latch holding part (88), which permits the passage of extended needles (13), while the inserter (19) in its working position forms a prolongation of the latch holding part (88) (FIG. 9).

18. Knitting machine of claim 3, characterized in that an apparatus is provided for the pattern-controlled engagement and disengagement of the cam (77) opening the thread gripper (50) and of the cam (75) which turns the inserters (19) to the working position.

19. Knitting machine of claim 1, characterized in that a gripper (79) is provided which is displaceable lengthwise of the needle bed and disposed on the side of the beginning of the knit, and which has two gripping jaws pressed resiliently together, the two free ends of the gripper jaws forming an entry gap (80) for the threads, whose opening is disposed opposite to the transport direction and at the level of the thread portions carried by the thread grippers (50) and the inserters (19) (FIG. 2, 3).

20. Knitting machine of claim 19, characterized in that a patterning device is provided for extending the needles (13) according to pattern, the needle selection for the determination of the beginning of the knit being performed such that, when the thread carriers pass through the working area, a starting needle (13*c*) situated ahead of the first needle that knits (13*b*) is extended, in order to catch the thread portions carried between the inserters (19) and the thread grippers (50) and the gripping means (79) and bring them into the position required for their reliable insertion into the first knitting needles (13*b*).

21. Knitting machine of claim 3, characterized in that the cams (68, 71) for the closing of the thread grippers (50) and for turning the inserters (19) to the nonworking position are constructed such that, at the end of the knit, first the inserters (19) are turned to their nonworking position so as to arrange the threads carried by them directly under the outspread ends of the two arms of the thread grippers (50), and then the thread grippers (50) are closed by a downward movement perpendicular to the threads.

22. Knitting machine of claim 1, characterized in that the thread carriers (18) are fastened each as a whole to one support each by means of a pivot pin disposed substantially perpendicular to the transport direction.

23. Knitting machine of claim 9, characterized in that the working position of the pivoted inserter (19) is secured by a lock (42) and that in the area of the cam (68) provided for turning the inserter (19) to the nonworking position there is provided a lock operating cam (65) (FIGS. 5 and 8).

24. Knitting machine of claim 5, characterized in that the two turned positions of the inserters (19) are set by stops on the thread carriers (18, 18′, 18″) which are engaged by the inserters (19) in the two turned positions by spring force (47) (FIG. 5).

25. Knitting machine of claim 23 or 24, characterized in that the lock (42) is biased by spring force (47) to a locking position.

26. Knitting machine of claim 23 or 24, characterized in that each thread carrier (18, 18′, 18″) has a pivot shaft (41) disposed parallel to the transport direction, for the pivoting of the corresponding inserter (19) and a tension spring (47) fastened at its ends to the thread carrier (18) and to the inserter (19).

27. Knitting machine of claim 26, characterized in that the lock (42) consists of a two-armed lever pivoted on a lock shaft (43) disposed parallel to the direction of transport of the thread carrier (18, 18′, 18″), whose one arm is intended for cooperation with the cam (65) and whose other arm bears a locking lug (45) which in the working position of the inserter (19) engages a projection (46) provided on the inserter (19) on the one side, and in the nonworking position of the inserter (19) engages it on the other side, and blocks the inserter (19) in these two positions, and that the one end of the tension spring (47) is fastened to the arm of the lever that bears the locking lug (45) (FIG. 5).

28. Knitting machine of claim 27, characterized in that the locking lug (45) is so constructed that the inserter (19) can be pivoted against the force of the tension spring (47) by the cam (68) from the nonworking position to the working position.

29. Knitting machine of claim 27, characterized in that the locking lug (45) is so constructed that the locking becomes tighter in the case of pressure on the inserter (19) in the direction of the nonworking position, and therefore can be released only by the action of the cam (65) on the control lever (44) of the lever.

30. Knitting machine of claim 8, characterized in that for the increasing and/or decreasing of the width of the knit at least the cam (77) acting on the thread gripper (50) and disposed at the beginning of the needle bed, and/or the cams (71 and 68) acting on the thread gripper (50) and on the inserter (19), respectively, are disposed displaceably along the needle bed (12).

* * * * *